US007896825B2

(12) United States Patent
Atkinson et al.

(10) Patent No.: US 7,896,825 B2
(45) Date of Patent: Mar. 1, 2011

(54) MEDICAL COMPRESSION DEVICES AND METHODS

(75) Inventors: Robert E. Atkinson, White Bear Lake, MN (US); Chad J. Kugler, Andover, MN (US)

(73) Assignee: Bridgepoint Medical, Inc., Plymouth, MN (US)

( * ) Notice: Subject to any disclaimer, the term of this patent is extended or adjusted under 35 U.S.C. 154(b) by 1096 days.

(21) Appl. No.: 11/452,291

(22) Filed: Jun. 14, 2006

(65) Prior Publication Data

US 2006/0287621 A1 Dec. 21, 2006

Related U.S. Application Data

(60) Provisional application No. 60/691,925, filed on Jun. 17, 2005.

(51) Int. Cl.
*A61H 7/00* (2006.01)

(52) U.S. Cl. ..... 601/151; 601/148; 601/11; 601/6

(58) Field of Classification Search ..... 601/6–11, 601/148–152; 602/13; 604/313–316; 606/201–203
See application file for complete search history.

(56) References Cited

U.S. PATENT DOCUMENTS

| | | | | |
|---|---|---|---|---|
| 3,824,992 | A * | 7/1974 | Nicholson et al. | 601/152 |
| 4,230,114 | A * | 10/1980 | Feather | 604/312 |
| 5,000,164 | A * | 3/1991 | Cooper | 601/11 |
| 5,022,387 | A | 6/1991 | Hasty | |
| 5,222,478 | A * | 6/1993 | Scarberry et al. | 601/44 |
| 5,688,225 | A * | 11/1997 | Walker | 601/11 |
| 7,214,202 | B1 * | 5/2007 | Vogel et al. | 601/11 |
| 7,384,379 | B2 * | 6/2008 | Egger | 482/78 |
| 2005/0187499 | A1 * | 8/2005 | Gillis et al. | 601/151 |

FOREIGN PATENT DOCUMENTS

| | | | |
|---|---|---|---|
| CA | 2499973 | A1 * | 4/2004 |
| CA | 2499973 | A1 * | 8/2004 |

* cited by examiner

*Primary Examiner* — Loan Thanh
*Assistant Examiner* — Valerie Skorupa
(74) *Attorney, Agent, or Firm* — Finnegan, Henderson, Farabow, Garrett & Dunner, L.L.P.

(57) ABSTRACT

Devices and methods for compressing a patient's limb or limbs (e.g., legs or arms) for treating or preventing ailments due to compromised venous or lymphatic circulation of the limb. Exemplary embodiments include, but are not limited to, sub-atmospheric compression, micro-pneumatic compression, and active fabric compression devices and methods.

33 Claims, 12 Drawing Sheets

COMPLETELY CIRCUMFRENTIAL PLANETARY ELEMENTS

INTERMITTENT CIRCUMFRENTIAL PLANETARY ELEMENTS

MEDICAL COMPRESSION DEVICES AND METHODS

CROSS REFERENCE TO RELATED APPLICATIONS

This application claims the benefit of U.S. Provisional Application No. 60/691,925, filed Jun. 17, 2005, under 35 U.S.C. §119(e). The entire disclosure of that provisional application is incorporated by reference herein.

FIELD OF THE INVENTION

The inventions described herein relate to devices and associated methods for compressing a portion of a patient's body, such as, for example, a patient's leg for therapeutic and prophylactic purposes.

BACKGROUND OF THE INVENTION

Blood flow disorders can lead to numerous health and cosmetic problems for people. Relatively immobile patients, such as post-operative patients, the bedridden, and travelers confined to tight quarters during airline travel, for example, are particularly at risk for the development of thromboses, or blood clots due to decreased blood flow. Varicose veins are another disorder resulting from problems with patient blood flow. Varicose veins are often a symptom of an underlying condition called venous insufficiency. Normal veins have one-way valves that allow blood to flow upward only to return to the heart and lungs. A varicose vein has valves that are not functioning properly. The blood can flow upwards, but tends to pool in the vein because of valve dysfunction. The varicose veins bulge because they are filled with pooled blood. Varicose veins are of primarily cosmetic concern, but also cause pain, leg heaviness, fatigue, itching, night cramps, leg swelling, and restless legs at night.

Varicose vein disease can be treated with various non-surgical techniques such as sclerotherapy or Endovenous Laser Treatment (EVLT). For some individuals it can also be treated by the nightly use of compression stockings. Compression stockings are elastic stockings that squeeze the veins and stop excess blood from flowing backward. These, and other known devices, tend to only provide an initial compression force at a low level that decreases over time upon continued deformation of the stocking.

Thus, there is a need for improved devices and associated methods for compressing a portion of a patient's body in terms of effectiveness and patient comfort.

SUMMARY OF THE INVENTION

To address this and other unmet needs, the present invention provides, in exemplary non-limiting embodiments, devices and methods for compressing a patient's limb or limbs (e.g., legs or arms) for treating or preventing deep vein thrombosis (DVT) (by stimulating fibrinolysis release), chronic venous insufficiency, venous stasis ulcers, lymphedema, stasis dermatitis, peripheral claudication, edema, varicose veins, and/or other ailments due to compromised venous or lymphatic circulation of the limb, for example. The devices described herein may also be used for wound healing, scar reduction, bone fracture stabilization, and other medical applications utilizing compression for therapeutic purposes. Exemplary embodiments include, but are not limited to, sub-atmospheric compression, micro-pneumatic compression, and active fabric compression devices and methods.

BRIEF DESCRIPTION OF THE DRAWINGS

It is to be understood that both the foregoing summary and the following detailed description are exemplary. Together with the following detailed description, the drawings illustrate exemplary embodiments and serve to explain certain principles. In the drawings.

FIGS. 2-2C are more detailed schematic and cross-sectional illustrations of the SAC device shown in FIG. 1;

DETAILED DESCRIPTION OF EXEMPLARY EMBODIMENTS

The following detailed description should be read with reference to the drawings in which similar elements in different drawings are numbered the same. The drawings, which are not necessarily to scale, depict illustrative embodiments and are not intended to limit the scope of the invention.

Sub-Atmospheric Compression Embodiments

Figure 1:
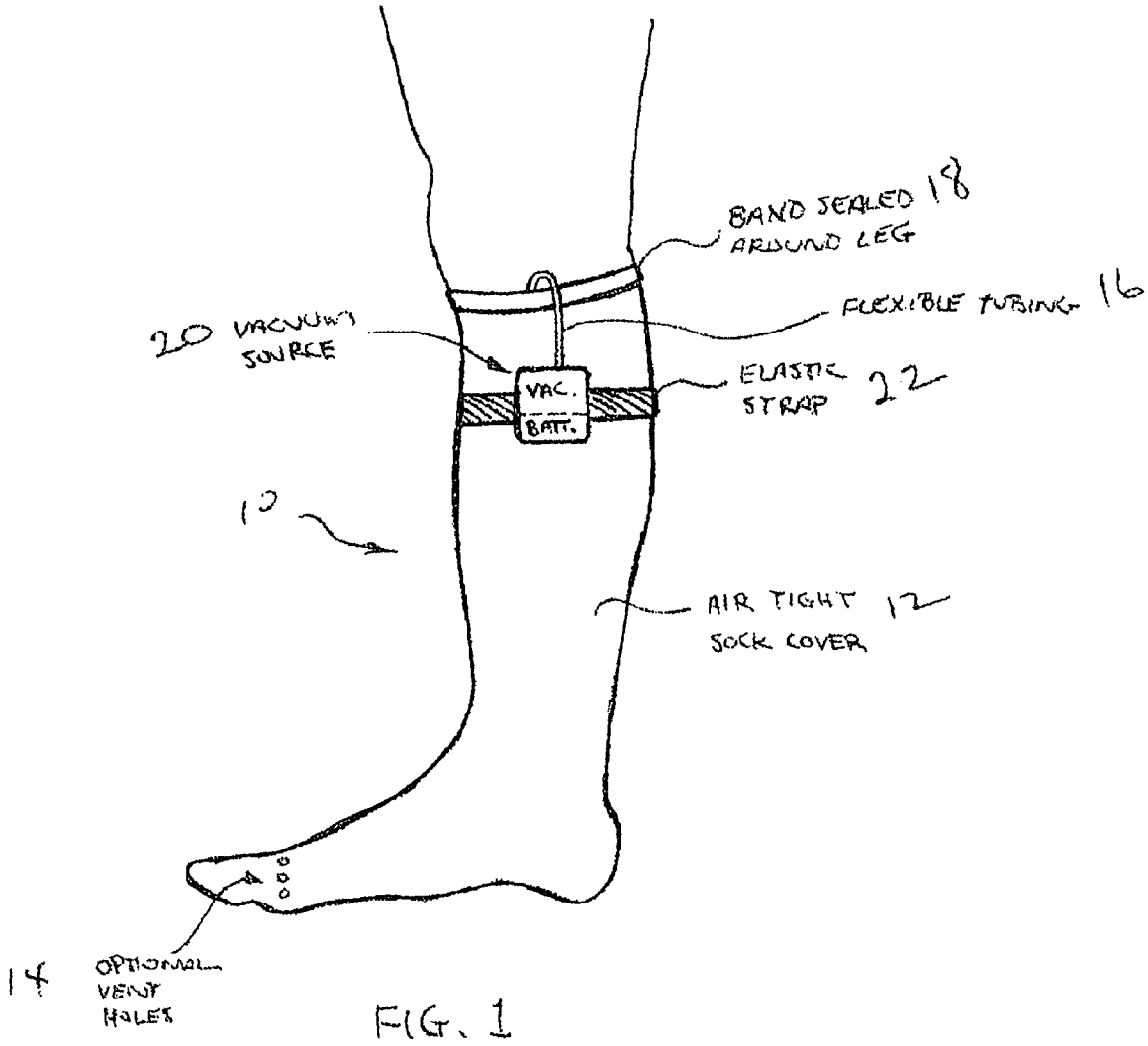
FIG. 1 is a schematic illustration of a sub-atmospheric compression (SAC) device.

With reference to FIG. 1, a sub-atmospheric compression (SAC) device 10 is shown schematically. The SAC device may be sock-like as shown, or may take any suitable geometry depending on the particular anatomy it is intended to cover as will be described in more detail hereinafter. The SAC device 10 generally includes a fluid impermeable (or low semi-permeable) cover 12 placed over the patient's limb (e.g., foot and calf). A space (not visible) is defined between the cover 12 and the limb. A vacuum source 20 is fluidically connected to this space by flexible tubing 16. A sealing band 18 is provided along the upper perimeter of the cover 12 to provide a fluid tight seal between the limb and the cover 12. A strap 22 or other fixation mechanism (e.g., Velcro, tape, etc.) may be used to secure the vacuum source 20 to the limb.

Upon actuation of the vacuum source 20, the space between the limb and the cover 12 is evacuated and a corresponding compressive force is uniformly applied to the limb proportional to the vacuum applied. For example, an approximate range of compression force is 0.01-0.99 atm, and a target pressure may be selected depending on the therapeutic or prophylactic application. For example, a target pressure range of 10-30 mmHg may be selected for the same or similar indications as for compression stockings (e.g., TEDS hose, Jobst stockings). Alternatively, a target pressure of 120 mmHg or more may be selected for the same or similar indications (e.g., DVT prophylaxis) as for conventional positive pressure intermittent pneumatic compression (IPC) devices and sequential compression devices (SCD). A pressure sensor and feedback circuit may be used to regulate the desired amount of vacuum applied. Vacuum (and thus compression) may be applied in a number of different manners, including constantly or intermittently, as a step function or a progressive function, singularly or sequentially, etc.

The vacuum source 20 may include a vacuum pump, power source (e.g., battery), and associated control circuitry and valves. The vacuum source 20 may vent to atmospheric pressure to provide intermittent compression. Also, the vacuum source 20 may apply positive pressure between vacuum cycles to provide ventilation to the limb under the cover 12. Alternatively or in addition, all or a portion of the cover may be made semi-permeable or vent holes 14 may be provided to provide ventilation.

Figure 2:
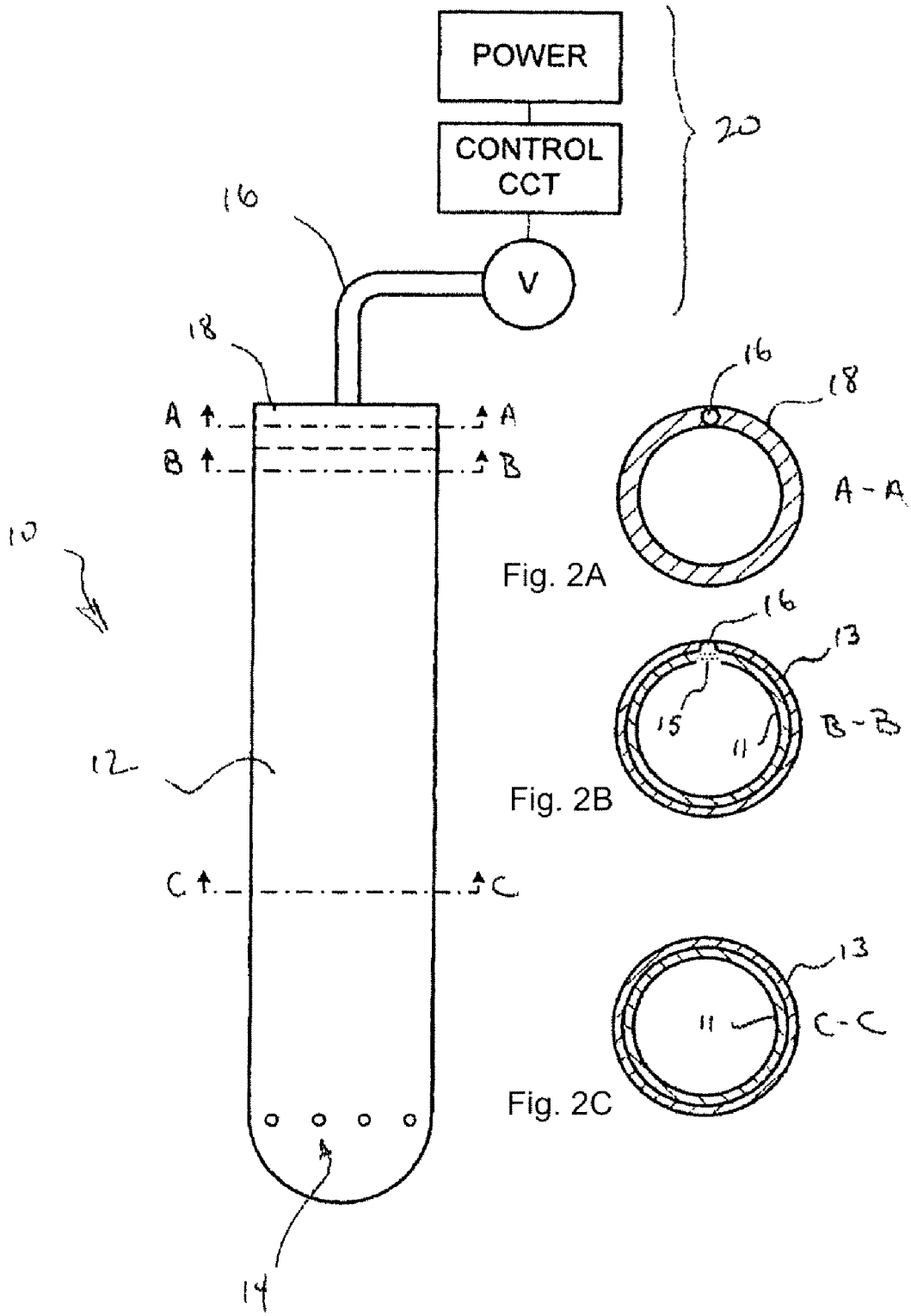

With reference to FIGS. 2-2C, a more detailed illustration of the SAC device 10 is shown schematically. The cover 12 of the SAC device 10 may include two layers, namely an inner absorbable layer 11 (e.g., cotton, cotton blends, other sock-like materials, etc.) to provide comfort, and an outer impermeable (or low semi-ermeable) layer 13. The outer layer 13 may be elastic (e.g., silicone, latex, polyurethane) or inelastic (e.g., PET film). The cover 12 may have a loose fit relative to the limb to facilitate easy donning. The outer layer 13 of the cover 12 may be placed over or integrally formed with the underlying absorbent layer 11. The sealed band 18 may be elastic (e.g., silicone, latex, polyurethane), may be a continuation of the outer layer 13 beyond the inner layer 11, and may have a relatively tight fit around the limb to provide an adequate seal between the cover and limb.

The connective tubing 16 may be reinforced to reduce the likelihood of kinking, and/or may be integrally formed with the outer layer 13 of the cover 12. To diffuse the air evacuated from under the cover 12 at the end of the tubing 16, a diffusion element 15 (e.g., open cell foam) may be utilized to avoid compromising air flow or causing pain and/or pressure sores on the limb.

Figures 3, 3A, 3B, 3C, 3D:
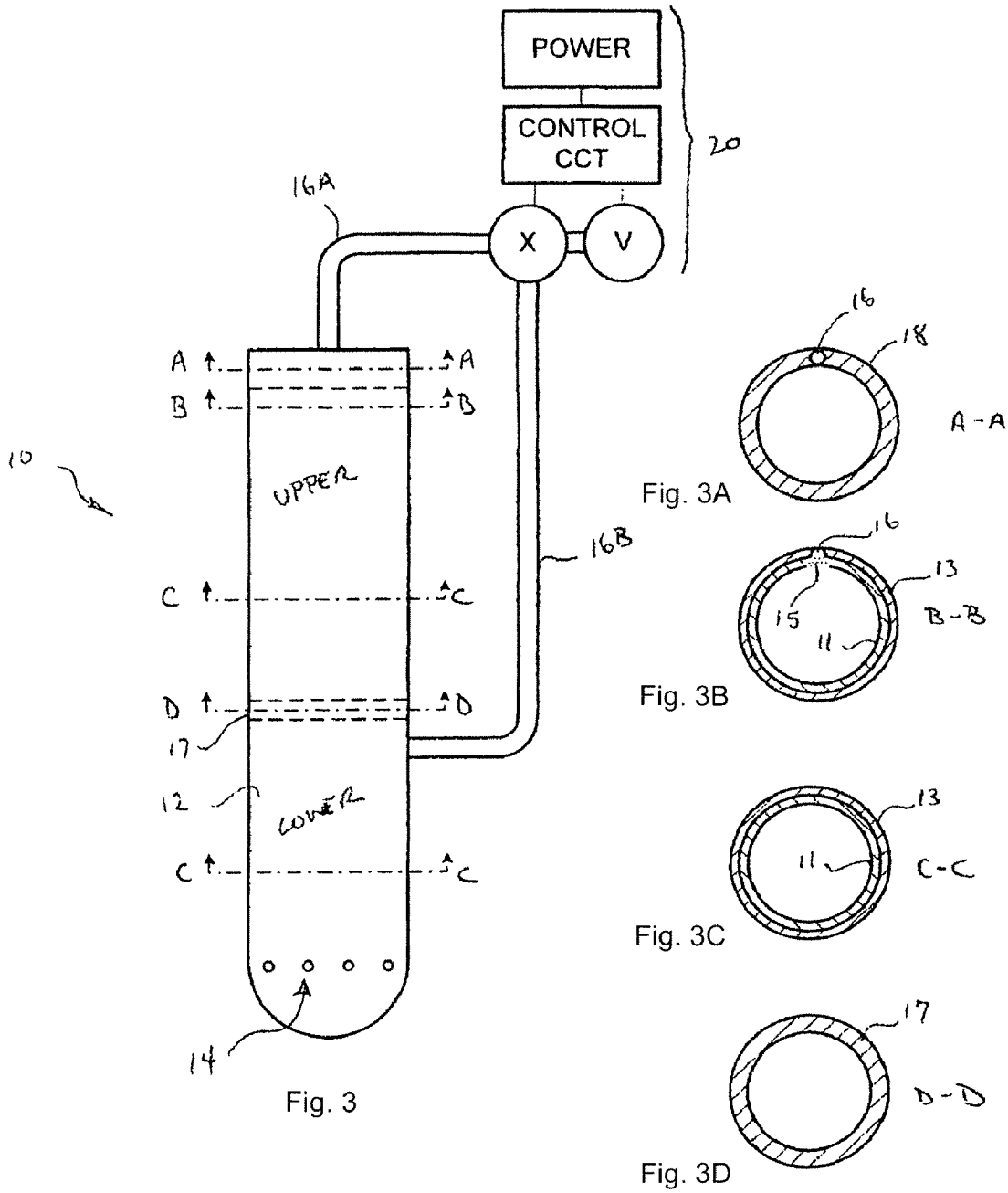
FIGS. 3-3D are schematic and cross-sectional illustrations of an alternative SAC device.

With reference to FIGS. 3-3D, an alternative SAC device 10 is shown schematically. In this embodiment, the device 10 is provided with an upper chamber and a lower chamber separated by internal sealing band 17, and independently connected to a switching valve of the vacuum source 20 by tubes 16A and 16B, respectively. This arrangement allows for independent or sequential compression of the upper and lower portions. The internal sealing band 17 may be formed of the same material as the upper sealing band 18 to form a seal between the limb and the cover 12.

Figures 4, 4A, 4B, 4C, 4D:
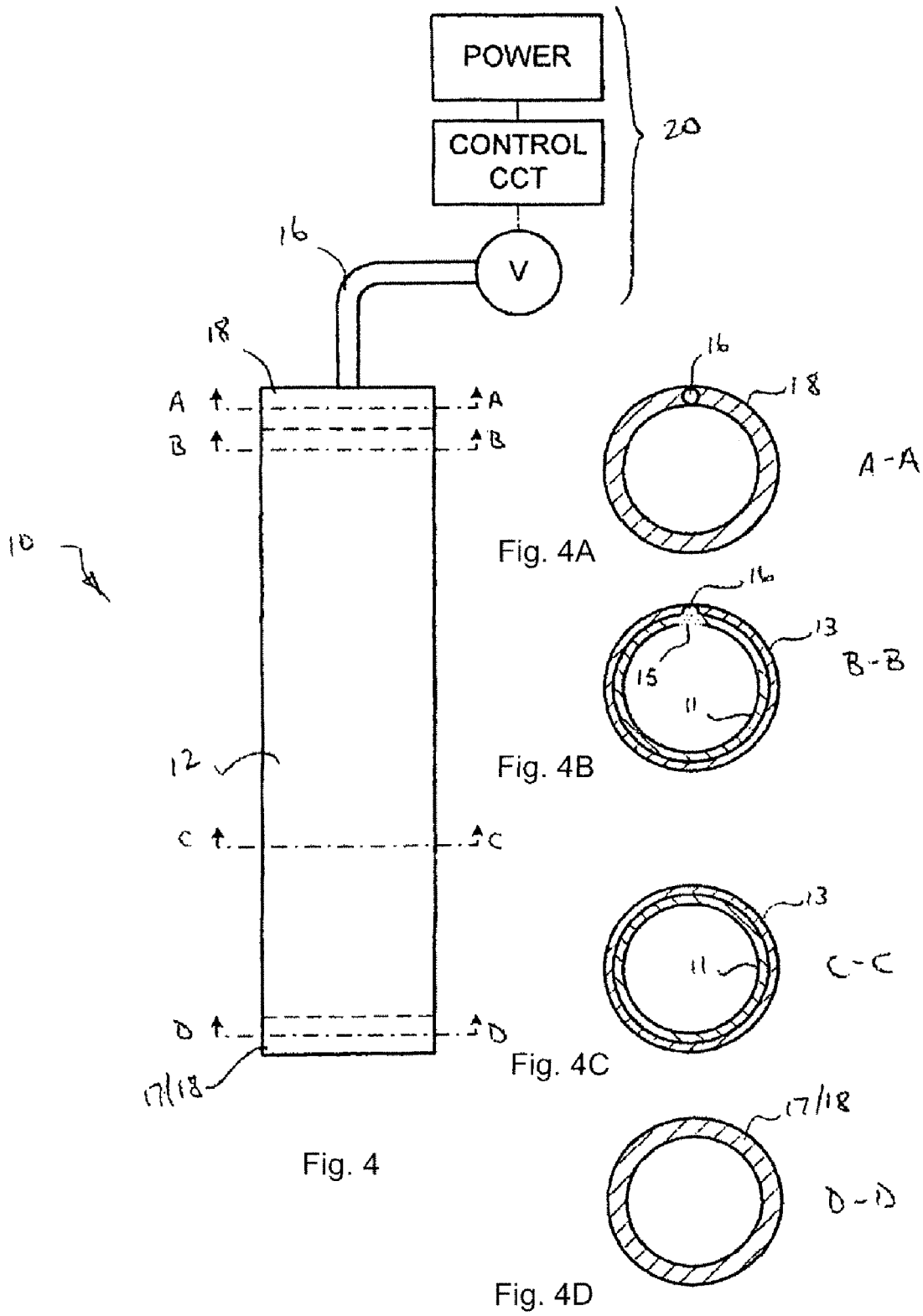
FIGS. 4-4D are schematic and cross-sectional illustrations of another alternative SAC device.

With reference to FIGS. 4-4D, another alternative SAC device 10 is shown schematically. In this embodiment, the device 10 has two open ends, whereas in prior embodiments the device had one open end and one closed end. The two open end arrangement shown in FIG. 4 renders the device 10 suitable for use over the arm or leg to the exclusion of the hand or foot, or with a separate compression device for the hand or foot. To facilitate the two open ended arrangement, the device 10 includes a lower sealing band 17/18 which may be formed of the same material as the internal sealing band 17 or the upper sealing band 18 to form a seal between the limb and the cover 12.

In each of the foregoing embodiments, the SAC device 10 may be used alone or in combination with other devices. For example, the SAC device 10 may be used under a hard or soft cast, or a wound dressing may be placed under the SAC device 10.

Figure 5A:
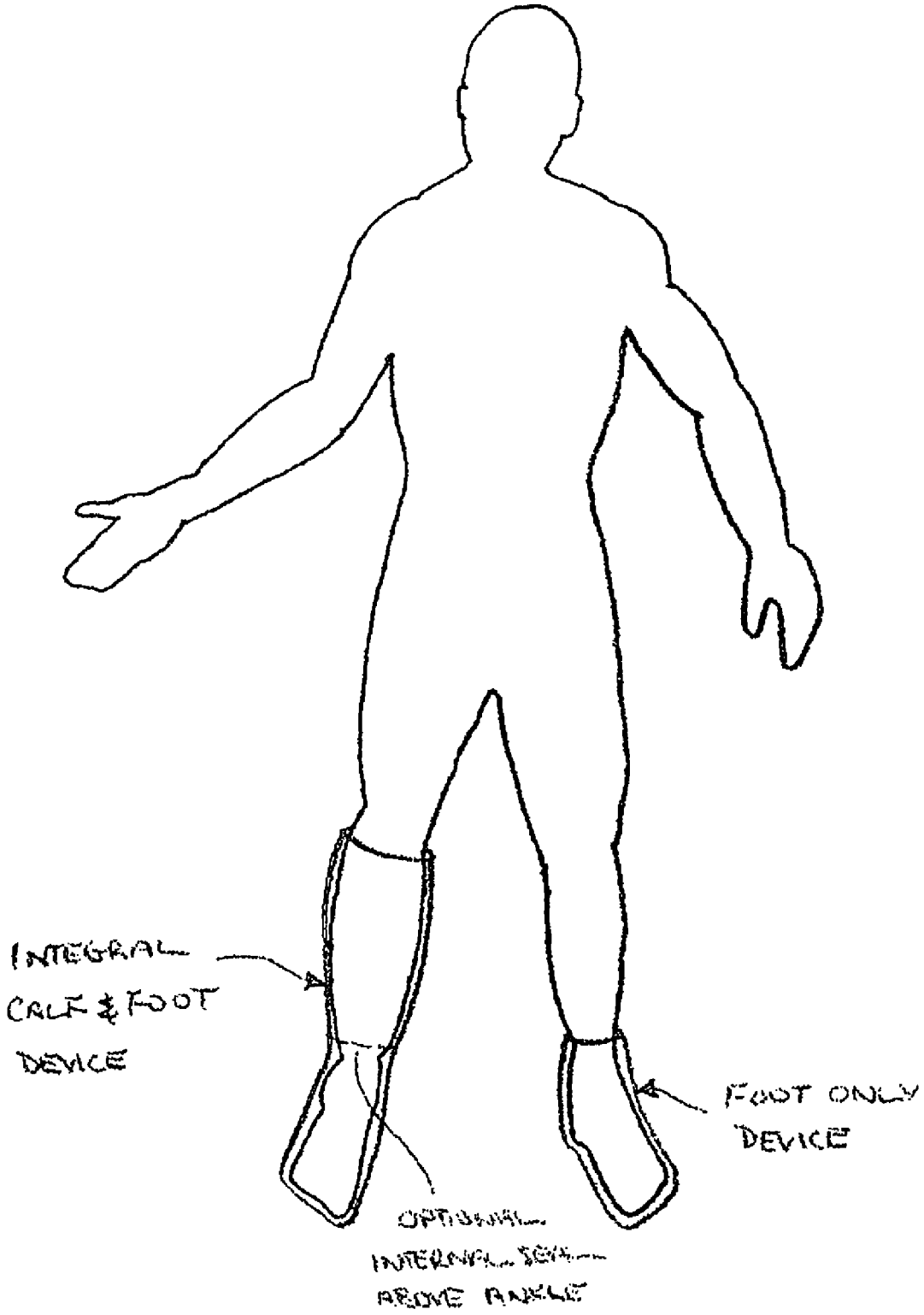
FIGS. 5A-5E are schematic drawings of various SAC devices adapted for different anatomical positions.
Figure 5B:
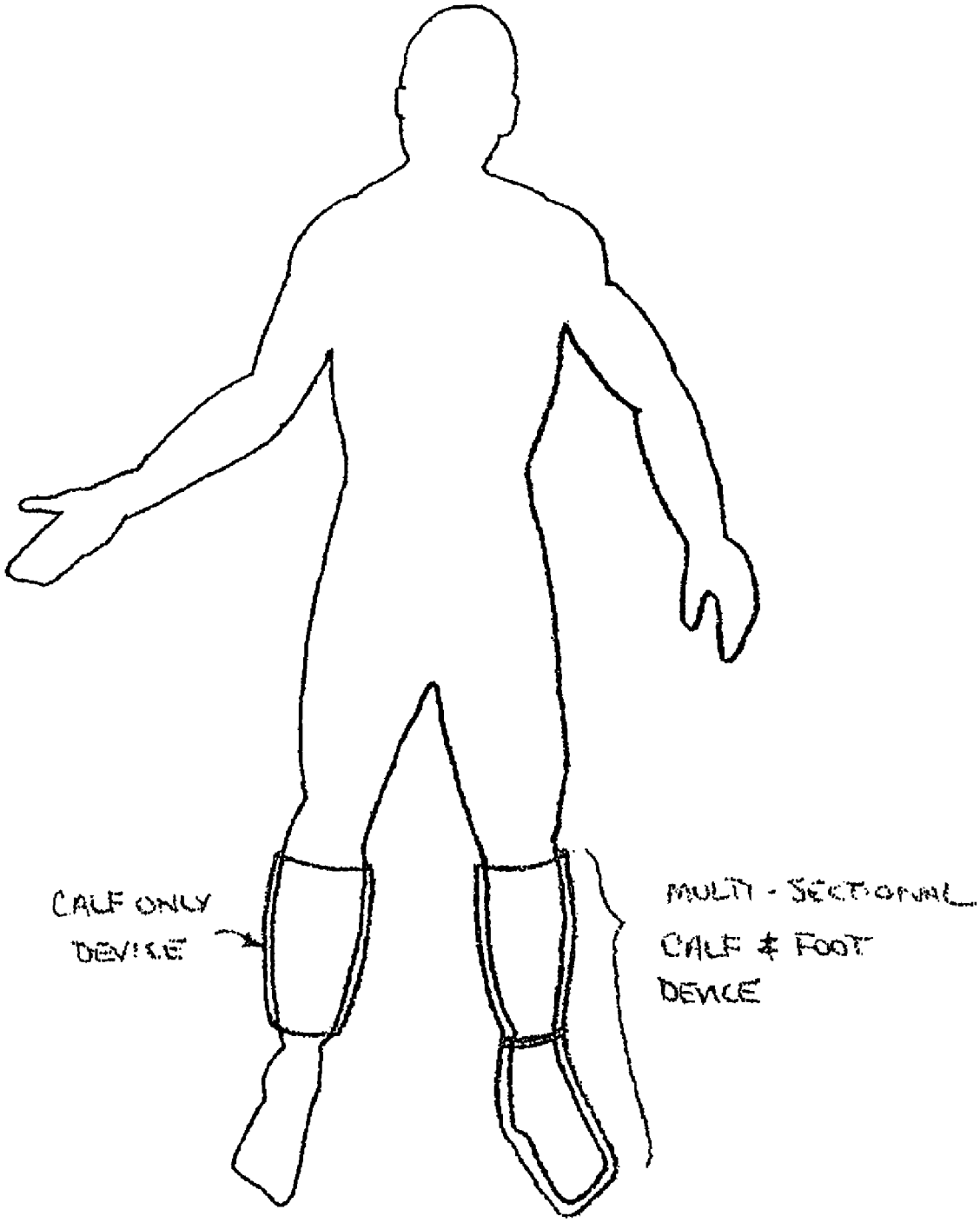
Figure 5C:
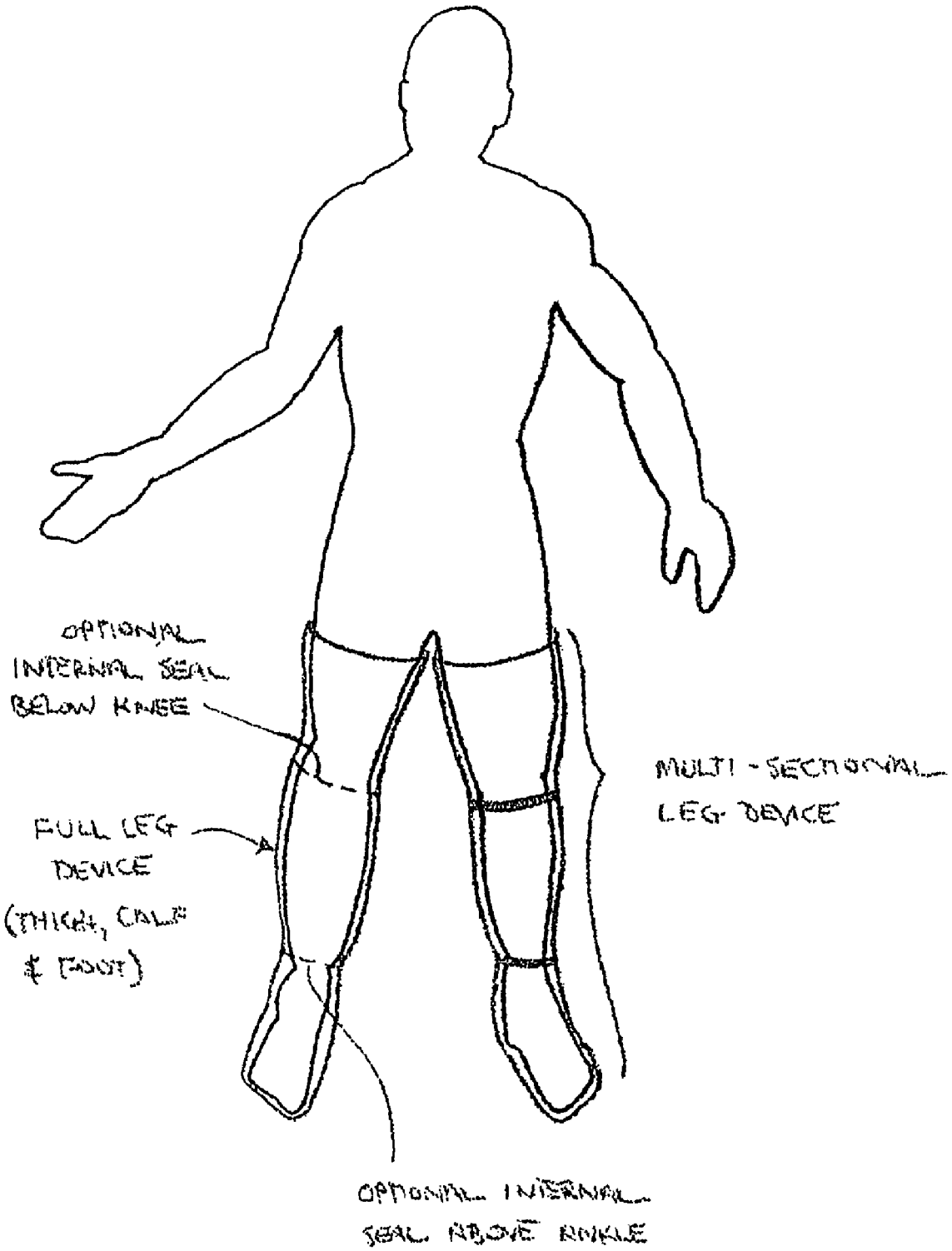
Figure 5D:
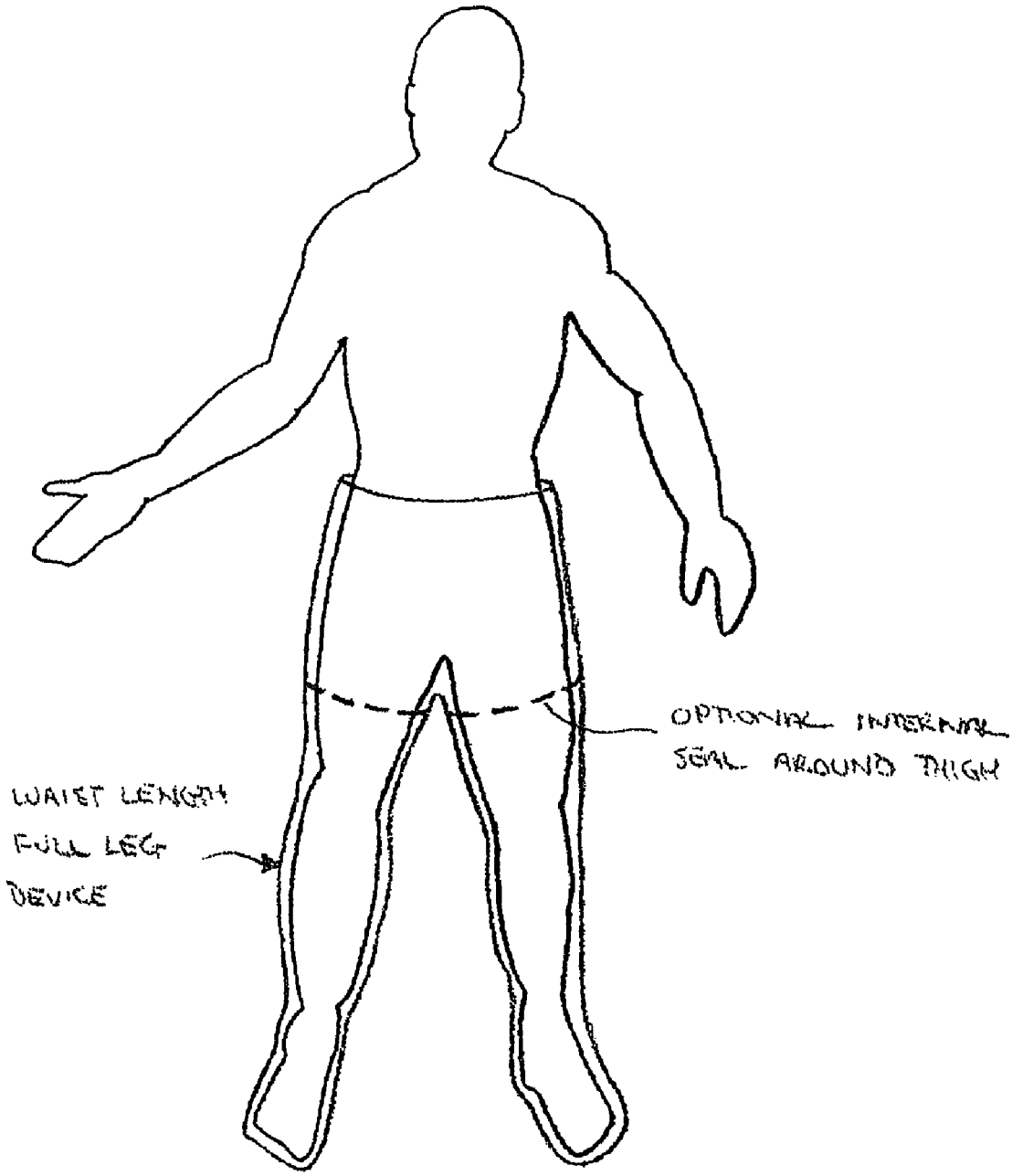
Figure 5E:
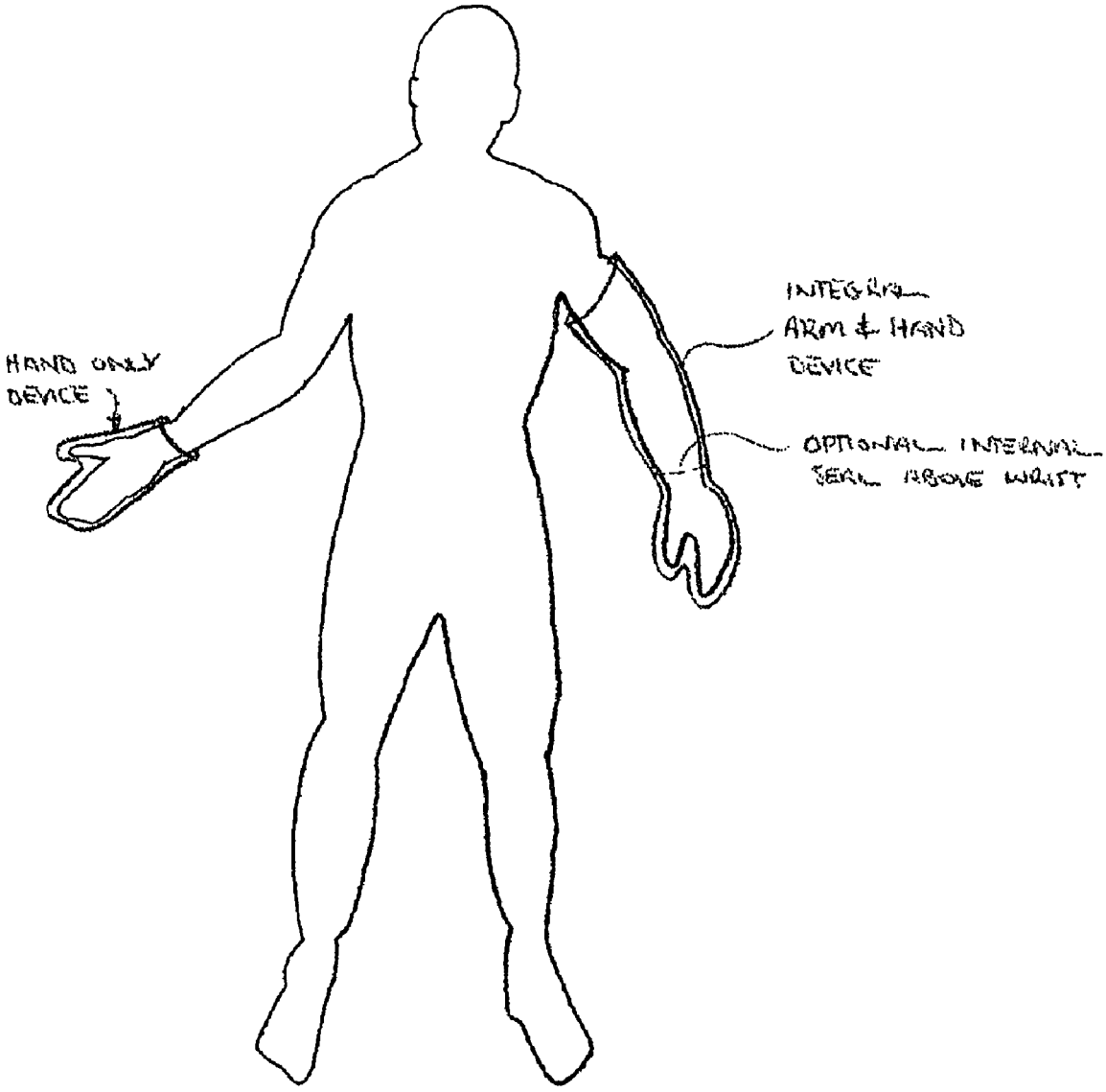

With reference to FIGS. 5A-5E, various SAC devices 10 adapted for different anatomical positions are shown schematically. In FIG. 5A, an integral foot and calf device is shown on the right leg, and a foot-only device is shown on the left leg. In FIG. 5B, a calf-only device is shown on the right leg, and a combination of a foot-only device and a calf-only device are shown on the left leg. In FIG. 5C, a full leg device is shown on the right leg, and a combination of a foot-only device, a calf-only device, and a thigh-only device are shown on the left leg. In FIG. 5D, a waist length two-leg device is shown. In FIG. 5E, a hand-only device is shown on the right hand, and an integral arm and hand device is shown on the left arm. These variations are provided by way of example, not limitation, and are applicable to other embodiments described herein.

Active Fabric Embodiments

Figure 6:
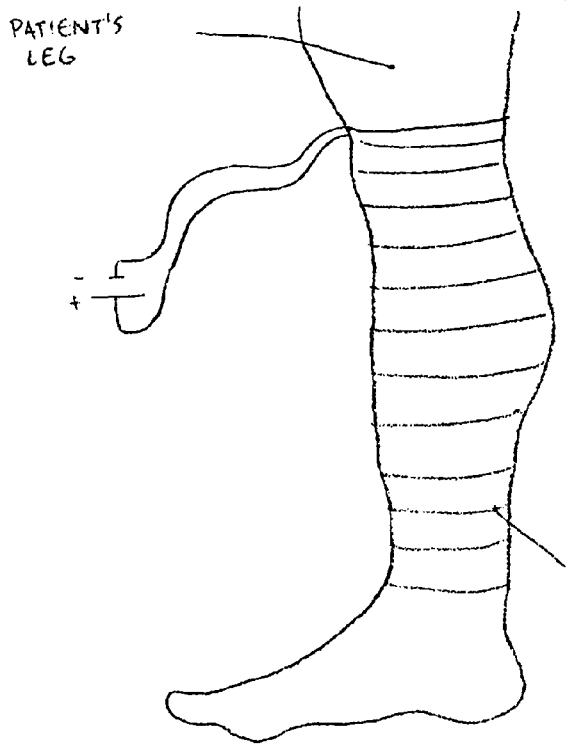
FIGS. 6, 7A and 7B are schematic illustrations of an active fabric compression device and variations thereof.
Figure 7B:
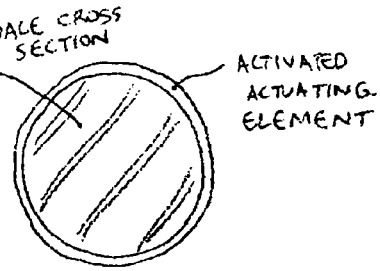
Figure 7A:
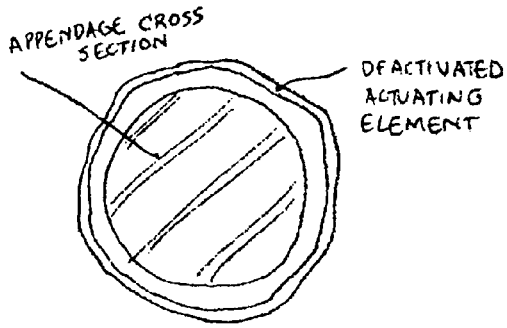

With reference to FIGS. 6, 7A and 7B, an active fabric compression device and variations thereof are illustrated schematically. With specific reference to FIG. 6, one embodiment uses an electrically, chemically or temperature sensitive active actuating element incorporated into a wearable garment (e.g. sock) to apply constant or cyclic pressure to an appendage (e.g. leg) of a patient. The actuating element may be incorporated into the sock during a primary manufacturing step (for example weaving or knitting) or may added to a sock during a subsequent step in the manufacturing process. Activation of the actuating element may cause the sock to radially contract and generate pressure between the sock and leg or expand and reduce the pressure.

The actuating element may be made of a superelastic "shape memory" material (e.g. nitinol) where dimensional changes can be initiated through resistance heating, a piezoelectric material (e.g. hydroxyapatite) where dimensional changes occur through the application of sufficient voltage, or a polymeric "artificial muscle" (e.g. cation-modified Polyacrylonitrile) where expansion and contraction of the material is achieved though a "reduction" process upon exposure to a relatively basic chemical solution and contraction is achieved through an "oxidation" process upon exposure to a relatively acidic chemical solution. An artificial polymeric muscle may also be housed in an exterior sheath or vessel that allows exposure of the material to the appropriate chemicals while preventing skin exposure. Chemical exposure may also be created through electrolysis by placing the artificial polymeric muscle in an electro-chemical cell.

In an embodiment where nitinol is used as the actuating means, nitinol wires may be woven into a sock. The superelastic material is in the expanded, dimensionally largest state when deactivated as seen in FIG. 7A. The sock is placed over a patient's leg and is electrically activated with enough current to resistively heat the wires. Sufficient heat induces an atomic structure change causing the "shape memory" material to contract and apply a pressure to the leg as seen in FIG. 7B. Removal of the current allows the material to cool and return to its original expanded dimension.

Micro-Pneumatic Compression Embodiments

Figure 9A:
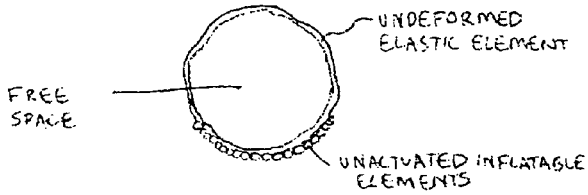
FIGS. 8, 9A-9C, 10, 11A, 11B, and 12 are schematic illustrations of a micro-pneumatic compression device and variations thereof.
Figure 9B:
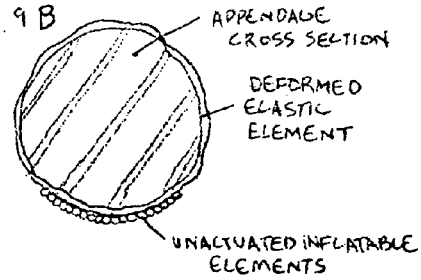
Figure 8:
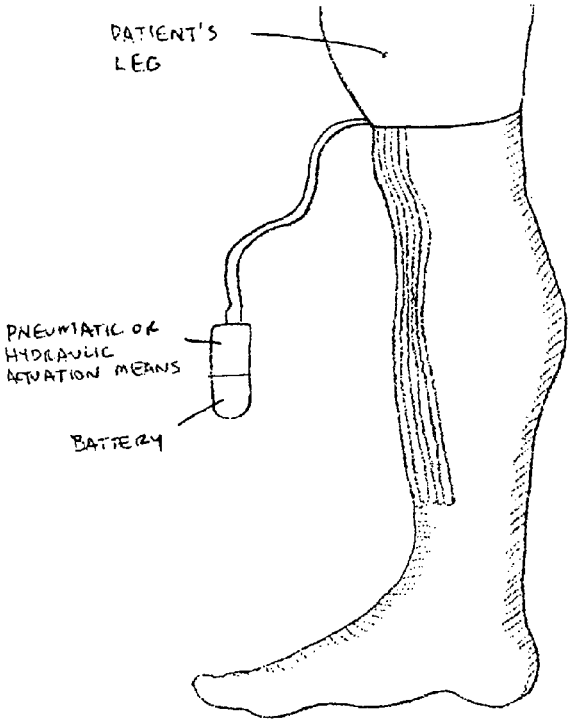

In FIGS. 8, 9A-9C, 10, 11A, 11B, and 12, a micro-pneumatic compression device and variations thereof are illustrated schematically. One embodiment uses one or more inflatable elements and one or more elastic elements incorporated into a wearable garment designed to apply constant or cyclic pressure to an appendage (e.g. leg) of a patient as seen in FIG. 8. In one embodiment, a sock that contains both inflatable and elastic elements is circumferentially smaller than the circumference of a patient's leg as seen in FIG. 9A. The act of positioning the sock over the leg dimensionally deforms the elastic element thus creating a pressure between the sock and leg as seen in FIG. 9B.

The aforementioned inflatable elements are fluidly connected to an inflation means. Examples of the inflation means include mechanisms capable of forcibly moving a liquid or gas which include but are not limited to an electrically driven piston pump, and electrically driven diaphragm pump or may also include a vessel of compressed gas.

Figure 9C:
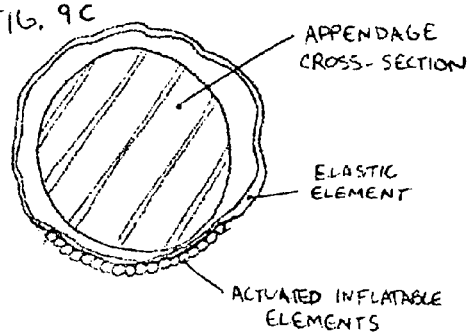

The injection of fluid from the actuating means increases the diameter of the inflatable elements. The interaction between adjacent inflatable elements or the interaction of the inflatable elements and the sock structure increases the garment's circumference. This circumference increase results in a reduction of the elastic member deformation and a decrease in the pressure between sock and leg. Sufficient inflation of the inflation elements allows the elastic member to achieve an un-deformed "strain free" state thus eliminating the pressure between sock and leg as seen in FIG. 9C. Deflation of the inflation elements returns the elastic element to its deformed state and restores the pressure.

Cyclic inflation and deflation of the inflation elements results in a cyclic pressure between sock and leg. The inflation means may also have the ability to sense when a patient is ambulatory. Patient ambulation may cause the inflation means to "turn off" while a sedentary period may cause activation means to "turn on".

Figure 10:
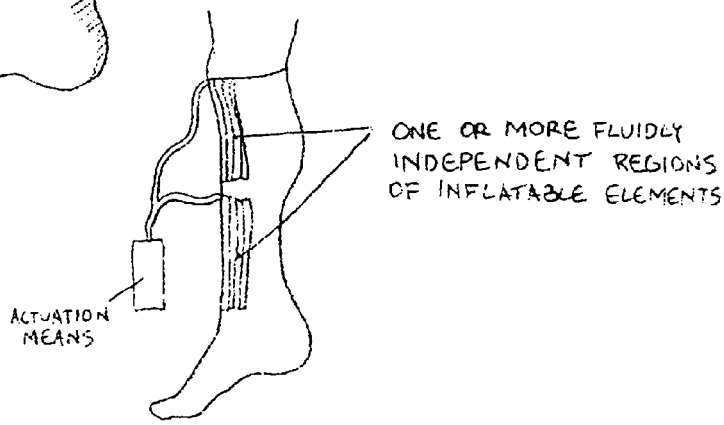
Figure 11A:
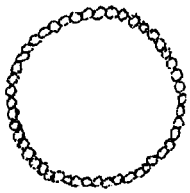
Figure 11B:
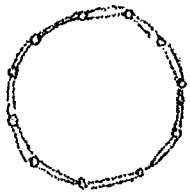

One variation of the embodiment includes one or more fluidly independent regions of inflating elements used to vary the inflation parameters (i.e. inflation duration, inflation pressure, deflation duration) as seen in FIG. 10. Variations to the number of inflation elements include but are not limited to a complete circumferential ring of planetary elements as seen in FIG. 11A and intermittent elements separated by elastic elements as seen in FIG. 11B.

Figure 12:
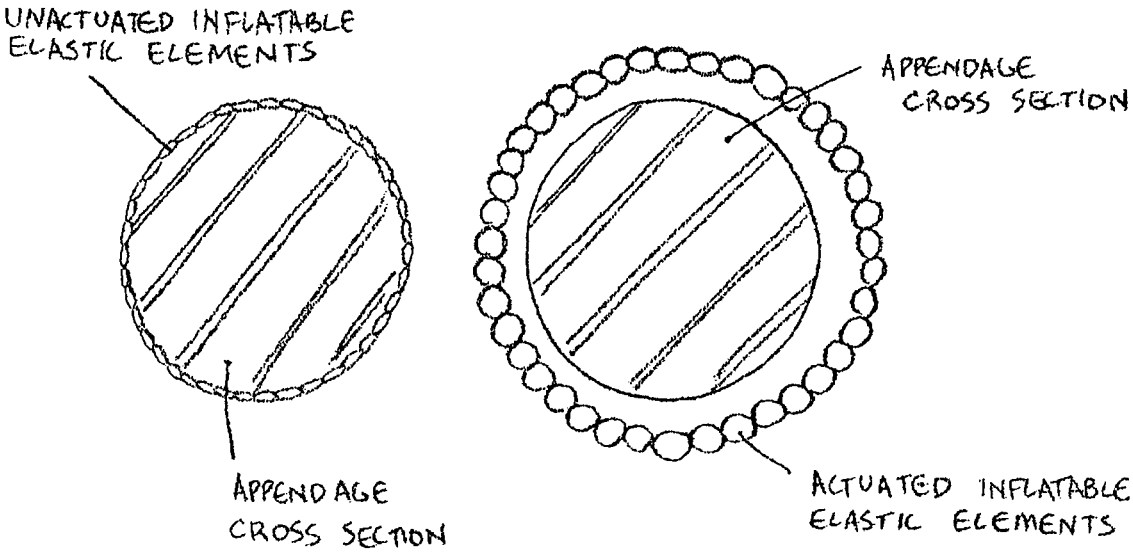

The embodiment may also be used for static compression of an appendage. The inflation elements may be activated to ease the difficulty of "putting on" and "taking off" the elastic sock. In this application, a syringe or similar inflation means may be used to inflate the inflation elements making the circumferentially larger than the patient's leg. In this state, the sock could be easily pulled on by patients with compromised physical strength. Static pressure would be applied to the appendage upon the deflation of the inflation elements as seen in FIG. 12.

A variation of the embodiment combines the elastic elements and the inflation elements. For example, the inflation elements may be made of an elastic material capable of deforming and applying circumferential pressure to an appendage. Activation of the inflation elements results in pressure reduction in a manner consistent with the aforementioned embodiments.

Embodiments described herein have a number of potential advantages, including uniform compression independent of anatomical geometry and size, increased release of fibrinolysis as compared to typical positive pressure intermittent pneumatic compression (IPC) and sequential compression devices due to compression along substantially the entire length of the device, increased patient compliance due to ease of donning and comfort (ventilation).

From the foregoing, it will be apparent to those skilled in the art that the present invention provides, in exemplary non-limiting embodiments, devices and methods for compressing a patient's limb or limbs (e.g., legs or arms) for treating or preventing ailments due to compromised venous or lymphatic circulation of the limb. Further, those skilled in the art will recognize that the present invention may be manifested in a variety of forms other than the specific embodiments described and contemplated herein. Accordingly, departures in form and detail may be made without departing from the scope and spirit of the present invention as described in the appended claims.

What is claimed is:

1. A device for providing a compression force to a patient's body comprising:

a covering configured to cover a portion of a patient's body, the covering having an outside surface and an inside surface configured to define a first space between the covering and the portion of the patient's body;

a sealing band provided proximate an end portion of the covering and configured to provide a fluid tight seal between the covering and the portion of the patient's body;

a vacuum source configured to be in fluid communication with the first space so that the application of a vacuum pressure to the first space results in compression of the portion of the patient's body; and a diffusion element located within an aperture of an innermost layer of the covering and configured to be between the vacuum source and the first space and between the outside surface and the first space.

2. The device of claim 1, wherein the innermost layer of the covering comprises an inner absorbable layer, and an outermost layer of the covering comprises an elastic material.

3. The device of claim 1, wherein connective tubing is configured to provide fluid communication between the vacuum source and the first space.

4. The device of claim 3, wherein the tubing is disposed between an inner surface and an outer surface of the sealing band, the tubing being parallel to the outside surface of the covering at the location where it is disposed between the inner and outer surface.

5. The device of claim 1, wherein the covering is comprised of a fluid impermeable material.

6. The device of claim 1, further comprising a pressure sensor and feedback circuit configured to regulate the amount of vacuum applied.

7. The device of claim 1, wherein the vacuum source is configured to apply a vacuum-pressure of about 10-30 mmHG to the first space.

8. The device of claim 1, wherein the vacuum source is configured to apply a vacuum pressure of about 120 mmHG or greater to the first space.

9. The device of claim 1, wherein the vacuum source is configured to vent to atmospheric pressure to provide intermittent compression.

10. The device of claim 1, wherein the vacuum source is configured to apply positive pressure between vacuum cycles to provide ventilation to the portion of the patient's body.

11. The device of claim 1, further comprising vent holes in the covering, the vent holes configured to be in fluid communication with the first space.

12. The device of claim 1, wherein the covering comprises a garment configured to cover a patient's limb, the garment having a closed end portion and an open end portion.

13. The device of claim 1, wherein the covering comprises a tubular garment configured to cover a patient's limb, the garment having a first opening at one end portion and a second opening at a second end portion.

14. The device of claim 13, wherein the sealing band is provided proximate the first opening, and a second sealing band is provided proximate the second opening, thereby defining the first space between the two sealing bands.

15. The device of claim 1, further comprising a second sealing band provided along an intermediate portion of the covering and configured to provide a second fluid tight seal between the covering and the portion of the patient's body such that a second space distinct from the first space is defined between the covering and the portion of the patient's body.

16. The device of claim 15, wherein the vacuum source is in fluid communication with the second space.

17. The device of claim 1, wherein the covering comprises a garment configured to cover a patient's foot, hand, arm, leg, knee, thigh, waist, or any combination thereof.

18. The device of claim 1, wherein the diffusion element comprises open cell foam.

19. The device of claim 1, wherein the diffusion element comprises a different material than a material of the inner surface.

20. The device of claim 1, wherein the diffusion element comprises a different material than a material of the innermost layer.

21. A method for providing compression forces to a patient's body comprising:

covering a portion of a patient's body with a covering such that a first space is defined between the covering and the portion of the patient's body, wherein the covering includes a diffusion element located within an aperture of an innermost layer of the covering, between a vacuum source and the first space, and between an outside surface of the covering and the first space;

providing a seal between the covering and the covered portion of the patient's body; and applying a vacuum pressure to the first space resulting in compression of the portion of the patient's body.

22. The method of claim 21, further comprising venting the first space to atmospheric pressure to provide intermittent compression.

23. The method of claim 21, further comprising applying positive pressure between vacuum cycles to provide ventilation to the portion of the patient's body.

24. The method of claim 21, further comprising adjusting the amount of vacuum applied based on a response of a pressure sensor and feedback circuit.

25. The method of claim 21, wherein the seal is formed by providing a sealing band proximate an end portion of the covering such that the sealing band provides a fluid tight seal between the covering and the portion of the patient's body.

26. The method of claim 25, further comprising a second sealing band provided along an intermediate portion of the covering and configured to provide a second fluid tight seal between the covering and the portion of the patient's body such that a second space distinct from the first space is defined between the covering and the portion of the patient's body.

27. The method of claim 21, wherein the innermost layer of the covering comprises an inner absorbable layer, and an outermost layer of the covering comprises an elastic material.

28. The method of claim 21, wherein the covering comprises a tubular garment configured to cover a patient's limb, the garment having a first opening at one end portion and a second opening at a second end portion and wherein a sealing band is provided proximate the first opening, and a second sealing band is provided proximate the second opening, thereby defining the first space between the two sealing bands.

29. The method of claim 21, wherein the diffusion element comprises open cell foam.

30. The method of claim 21, wherein the vacuum pressure is applied from a tube disposed through the seal and parallel to the outside surface of the covering.

31. The method of claim 21, wherein the covering includes vent holes configured to be in fluid communication with the first space.

32. A device for providing a compression force to a patient's body comprising:

a covering configured to cover a portion of a patient's body, the covering having an innermost layer of absorbable material and an outermost layer of elastic material, the covering further having an outside surface and an inside surface configured to define a first space between the covering and the portion of the patient's body;

a sealing band provided proximate an end portion of the covering and configured to provide a fluid tight seal between the covering and the portion of the patient's body;

a vacuum source configured to be in fluid communication with the first space so that the application of a vacuum pressure to the first space results in compression of the portion of the patient's body, wherein connective tubing is configured to provide fluid communication between the vacuum source and the first space, the tubing being disposed between an inner surface and an outer surface of the sealing band, the tubing being parallel to the outside surface of the covering at the location where it is disposed between the inner and outer surfaces;

vent holes in the covering, the vent holes configured to be in fluid communication with the first space so that the application of the vacuum pressure to the first space provides ventilation to the portion of the patient's body; and a diffusion element located within an aperture of the innermost layer of the covering and configured to be between the vacuum source and the first space and between the outside surface and the first space.

33. A device for providing a compression force to a patient's body comprising:

a covering configured to cover a portion of a patient's body, the covering having an outside surface and an inside surface configured to define a first space between the covering and the portion of the patient's body;

a sealing band provided proximate an end portion of the covering and configured to provide a fluid tight seal between the covering and the portion of the patient's body;

a vacuum source configured to be in fluid communication with the first space so that the application of a vacuum pressure to the first space results in compression of the portion of the patient's body;

vent holes in the covering, the vent holes configured to be in fluid communication with the first space so that the application of the vacuum pressure to the first space provides ventilation to the portion of the patient's body; and a diffusion element located within an aperture of the innermost layer of the covering and configured to be between the vacuum source and the first space and between the outside surface and the first space.

* * * * *